US007441753B1

(12) United States Patent
Wang

(10) Patent No.: US 7,441,753 B1
(45) Date of Patent: Oct. 28, 2008

(54) CARBURETOR

(75) Inventor: Ming-Ching Wang, Shulin (TW)

(73) Assignee: Borch Corporation, Taipei County (TW)

( * ) Notice: Subject to any disclaimer, the term of this patent is extended or adjusted under 35 U.S.C. 154(b) by 21 days.

(21) Appl. No.: 11/797,371

(22) Filed: May 3, 2007

(51) Int. Cl.
*F02M 7/14* (2006.01)

(52) U.S. Cl. ..... 261/64.1; 261/64.4; 261/69.1; 261/DIG. 68

(58) Field of Classification Search ..... 261/34.2, 261/35, 64.1, 64.3, 64.4, 69.1, 69.2, DIG. 68
See application file for complete search history.

(56) References Cited

U.S. PATENT DOCUMENTS

| | | | | | |
|---|---|---|---|---|---|
| 1,405,777 | A * | 2/1922 | Good | 261/50.2 |
| 1,990,702 | A * | 2/1935 | Leibing | 261/69.1 |
| 2,194,540 | A * | 3/1940 | Breeze | 261/49 |
| 2,580,384 | A * | 1/1952 | Hazen et al. | 261/24 |
| 2,668,698 | A * | 2/1954 | Rollins | 261/41.1 |
| 2,871,002 | A * | 1/1959 | Gall | 261/69.1 |
| 3,201,096 | A * | 8/1965 | Barr | 261/41.5 |
| 3,778,038 | A * | 12/1973 | Eversole et al. | 261/50.1 |
| 4,711,222 | A * | 12/1987 | Rawlings | 123/555 |
| 5,176,855 | A * | 1/1993 | Jones | 261/39.3 |
| 5,762,832 | A * | 6/1998 | Glew | 261/36.2 |
| 6,042,088 | A * | 3/2000 | Wang | 261/39.1 |
| 6,092,793 | A * | 7/2000 | Yanagii | 261/35 |
| 6,264,175 | B1 * | 7/2001 | Wang | 261/44.5 |
| 2005/0257428 | A1 * | 11/2005 | Glew | 48/214 R |

FOREIGN PATENT DOCUMENTS

| | | | | |
|---|---|---|---|---|
| DE | 3819661 | A1 * | 12/1989 | 261/DIG. 68 |
| TW | 398577 | * | 7/2000 | |
| TW | M398577 | | 7/2000 | |

* cited by examiner

*Primary Examiner*—Richard L Chiesa
(74) *Attorney, Agent, or Firm*—Rosenberg, Klein & Lee

(57) ABSTRACT

A carburetor includes a base, a Venturi cone assembly, a cam assembly, a horsepower adjustment assembly, and a vacuum horsepower adjustment valve. The Venturi cone assembly is mounted in the base. A supporting portion of a cone collides with a cam of the cam assembly. An oil line rotation wheel of the horsepower adjustment assembly is drawn by an oiling line to drive the fan blade. The amount of displacement of the cone of the Venturi cone assembly under vacuum suction from the engine is controlled by a cam of the cam assembly. The vacuum horsepower adjustment valve automatically supplies enough fuel to the engine. Accordingly, the present invention can make the fuel burn sufficiently, effectively improving efficiency and reducing air pollution.

7 Claims, 8 Drawing Sheets

CARBURETOR

BACKGROUND OF THE INVENTION

1. Field of the Invention

The present invention relates to a carburetor, and more especially to a carburetor for locomotives with a cam assembly and a vacuum horsepower adjustment valve, which is more efficient, saves fuel and reduces pollution.

2. Description of the Prior Art

The design of carburetors is important to improving the performance of locomotives. When consumers purchase locomotives, besides the speed of the locomotive, fuel efficiency and environmental protection are important factors which need to be considered. So before locomotives sold out, most of them need to have their idle-speed oil passage adjusted to minimize the amount of gas (such as HC, NOx, CO etc.) for obtaining the optimal fuel saving point, thereby achieving a state in which gas exhaust reach their lowest and fuel use is minimized.

Taiwan Patent No. 398577, published on Jul. 11, 2000, provides an automatically adjustable carburetor which reduces fuel consumption and pollution. The carburetor has an automatically adjustable choke device in an air inlet path. The choke device is disposed in front of a throttle valve with an oil injection needle in the air inlet path. The choke device includes a fixing axle, an air inlet annular base, a pair of clip springs, a choke cone, and a spring. The choke cone controls the air draw into the carburetor, so as to improve the performance of the carburetor and gas exhaust.

However, a main oil path of the above automatically adjustable carburetor which reduces fuel consumption and pollution uses an oiling line to drive a throttle. When the locomotive moves at high speeds, due to the cone design of the oil injection needle, a gap between the oil injection needle and an emulsifying pipe becomes larger following the movement of the oiling line so that the overflowed fuel particles is difficult to atomize and fuel cannot burn sufficiently, thereby causing more pollution. Furthermore, when the choke cone runs under vacuum suction from the engine, the precise location of the choke cone cannot be controlled effectively, thereby the amount of air input cannot be controlled well and the mixture of the fuel and air is unstable.

Hence, the inventors of the present invention believe that the shortcomings described above are able to be improved and suggest the present invention which is of a reasonable design and is an effective improvement based on deep research and thought.

SUMMARY OF THE INVENTION

An object of the present invention is to provide a carburetor, which controls a Venturi cone assembly using a cam to change the design of a main oil passage so that a core can not only choke air, but also blocks fumes from the fuel. The present invention adopts a vacuum horsepower adjustment valve as an assistant oil passage, thereby making the mixture of fuel and air more stable, reducing pollution and improving performance.

To achieve the above-mentioned object, a carburetor in accordance with the present invention is disclosed. The carburetor includes a base, having a center flow path, two ends of which are respectively an air inlet port and an air outlet port. a supporting portion is mounted on one side of the air inlet port on the base. The supporting portion and the base form an annular exit for the main oil path therebetween. A Venturi cone assembly is mounted in the center flow path and includes a fixing axle and a cone. The fixing axle is fixed on the supporting portion and the cone movably pivoted on the fixing axle. The carburetor further includes a cam assembly including a cam spindle, a cam and a connecting board. The cam spindle is pivotedly mounted close to a center of the base. The cam and the connecting board are respectively mounted inside and outside the base and connect with the cam spindle. The cam abuts against the Venturi cone assembly. The carburetor further includes a horsepower adjustment assembly, including a fixed shaft for a fan blade, a fan blade, and an oil line rotation wheel. The fixed shaft for a fan blade is pivotedly mounted on the base close to the air outlet port on the same side and the cam assembly. The fan blade and the oil line rotation wheel are respectively mounted inside and outside the base and connect with the fixed shaft for a fan blade. The carburetor further includes a vacuum horsepower adjustment valve, mounted on a top of the base and including a vacuum valve cover and an auxiliary oil needle. A film is placed between the vacuum valve cover and the base and connects with the auxiliary oil needle. The auxiliary oil needle vertically extends through the base and movably extends into the center flow path.

The efficacy of the present invention is as follows: the cam of the present invention controls the shift of the cone of the Venturi cone assembly under vacuum suction from the engine to limit the position, to mix the air and fuel in a proper amount, and burns the entirety of the fuel. Furthermore, the exit for the main oil path is formed in front of the cone and has a fixed size so that the fuel and air are mixed more uniformly and the fuel can burn sufficiently. Additionally, the vacuum horsepower adjustment valve can automatically adjust the fuel supply at varied speeds to provide better horsepower and improve the efficacy of the carburetor.

To further understand feature and technical contents of the present invention, please refer to the following detailed description and drawings related the present invention. However, the drawings are only to be used as references and explanations, not to limit the present invention.

DETAILED DESCRIPTION OF THE INVENTION

Figure 1:
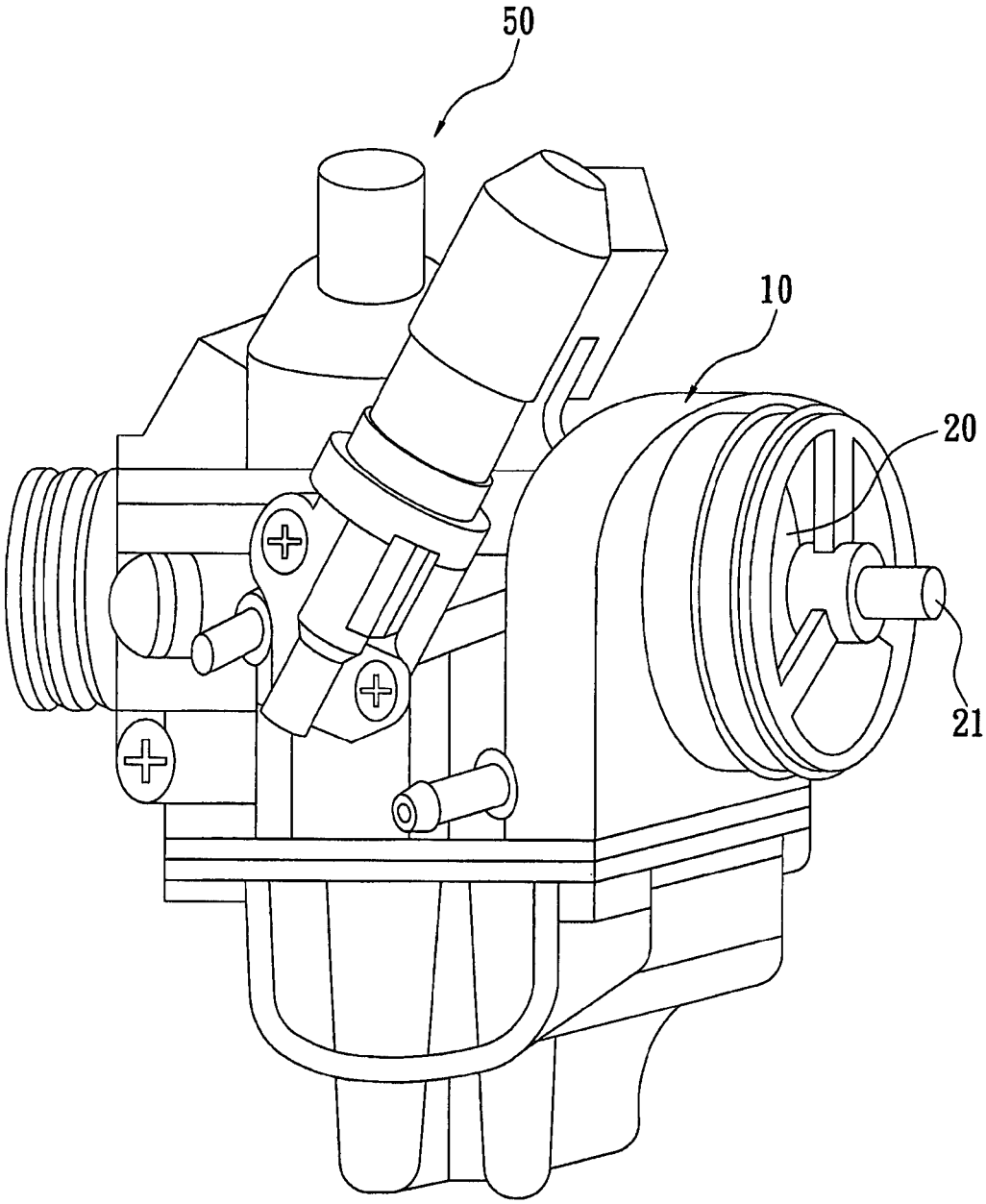
FIG. 1 is a perspective view of the present invention.
Figure 2:
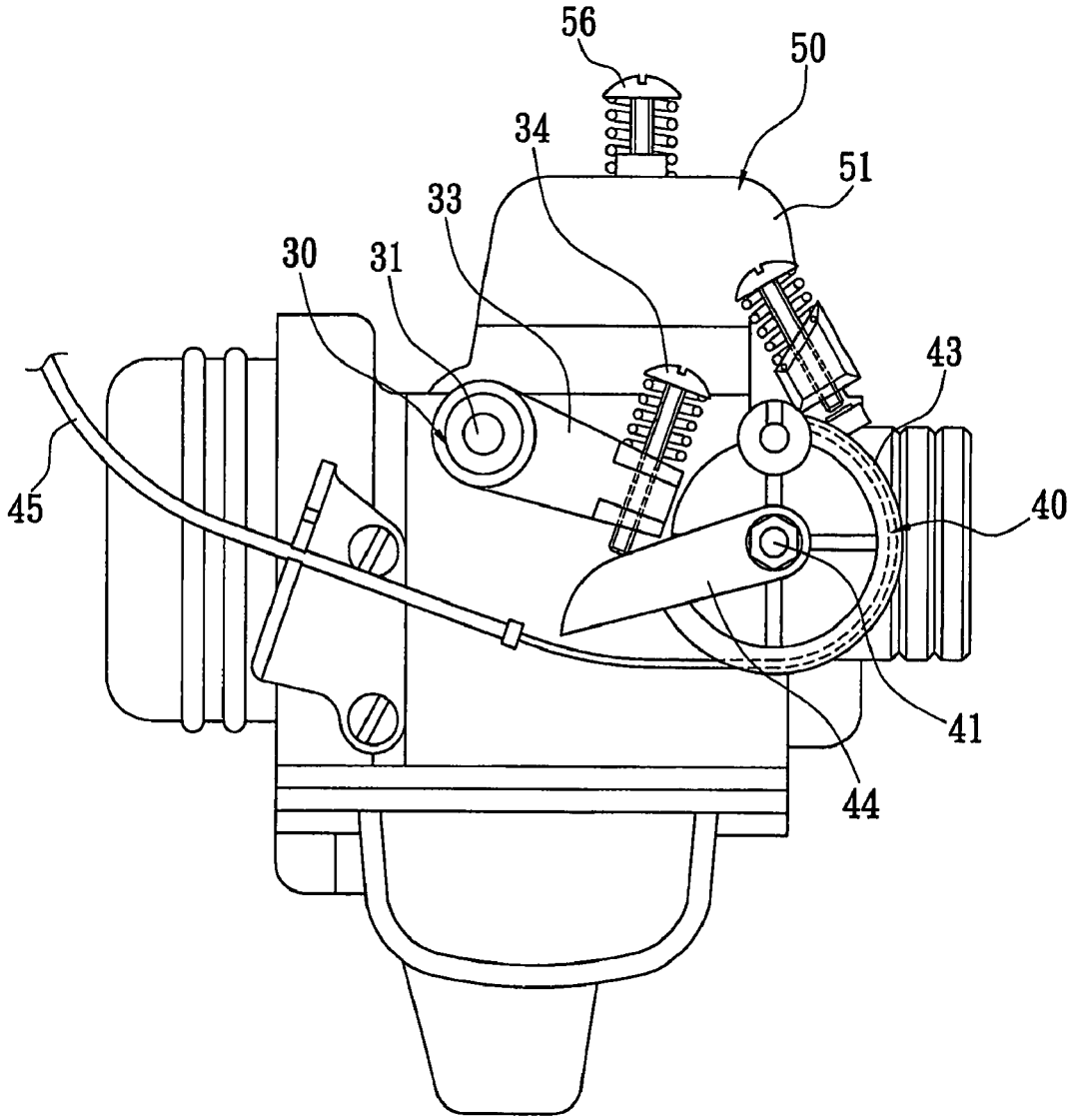
FIG. 2 is a side elevational view of the present invention.
Figure 3:
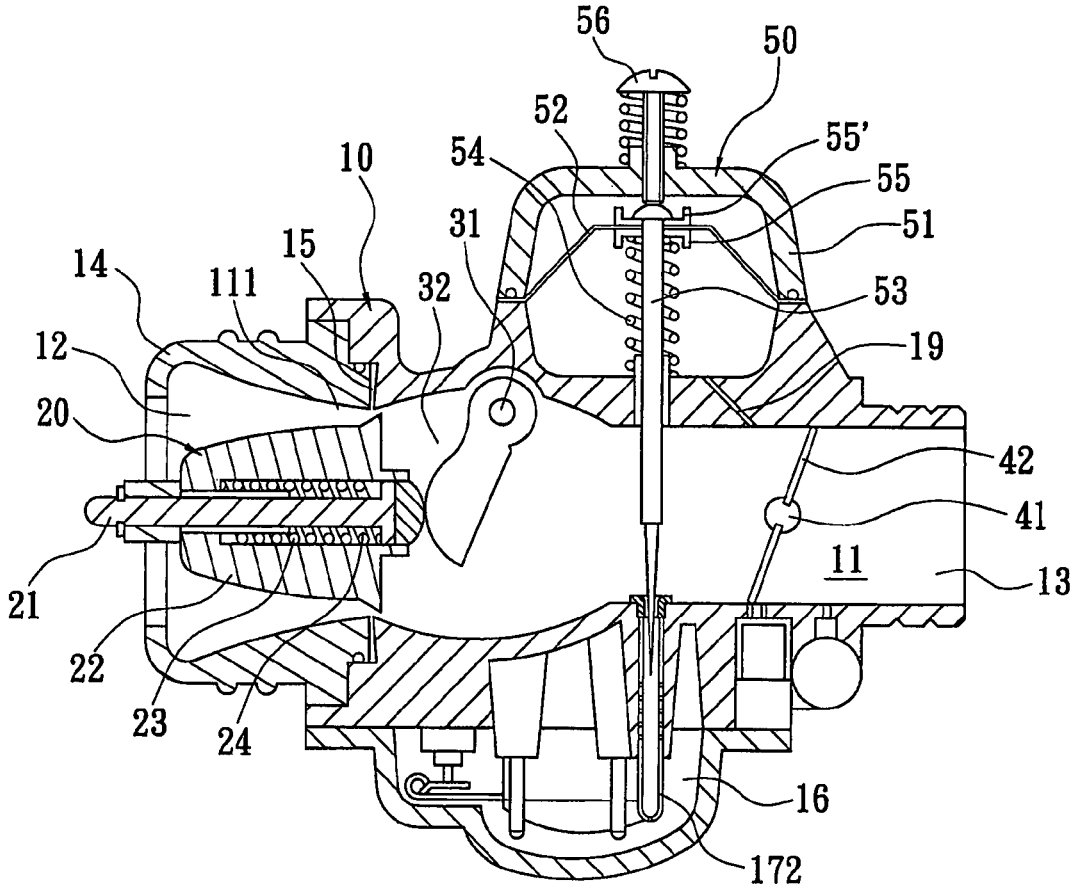
FIG. 3 is a sketched view of a fan blade of the present invention, in a closed state.

Please refer to FIGS. 1-3 in which a carburetor in accordance with a preferred embodiment of the present invention is shown. The carburetor includes a base 10, a Venturi cone assembly 20, a cam assembly 30, a horsepower adjustment assembly 40, and a vacuum horsepower adjustment valve 50.

Figure 6:
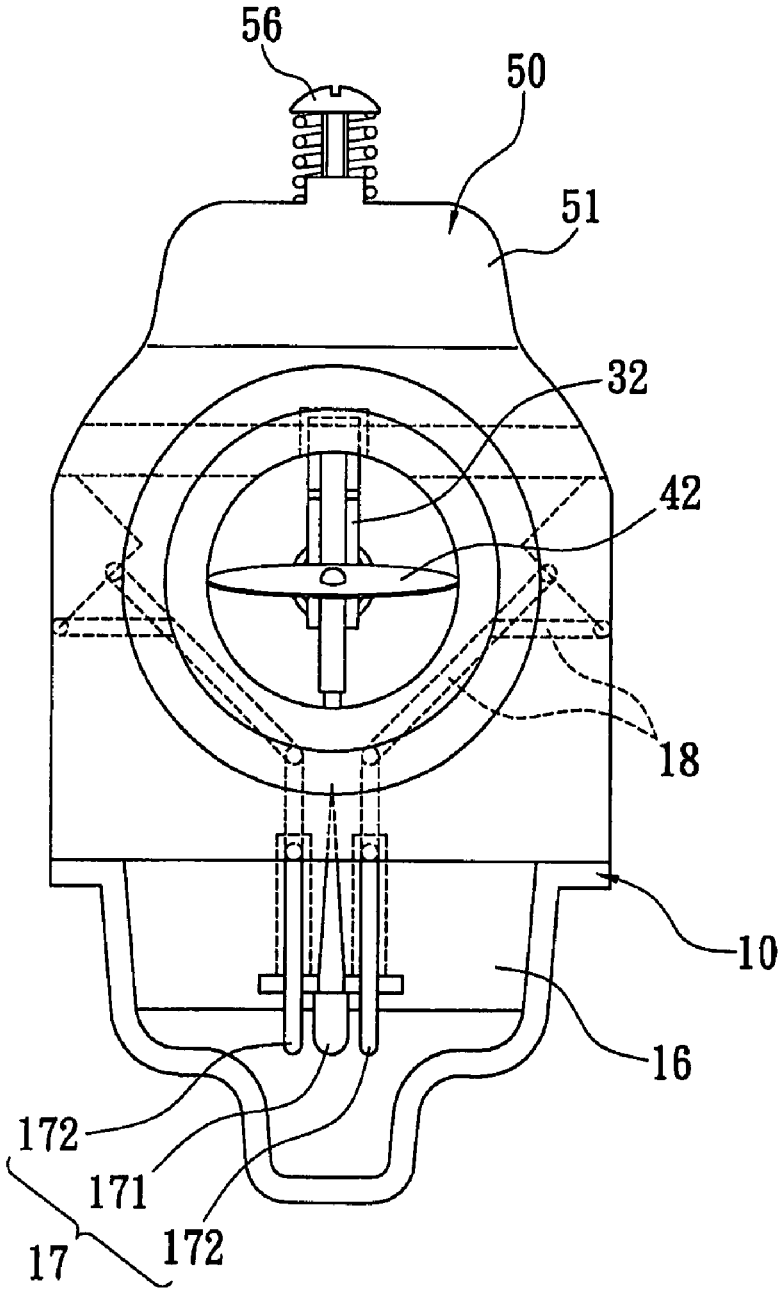
FIG. 6 is a front elevational view of an emulsifying pipe for the main oil path and an emulsifying pipe for the assistant oil path of the present invention.

The base 10 has a center flow path 11 through an inside thereof and forms an air inlet port 12 and an air outlet port 13 at opposite ends of the center flow path 11 respectively. A supporting portion 14 is mounted on the base 10 at the side of the air inlet port 11. An annular exit for the main oil path 15 is formed between the supporting portion 14 and the base 10. The base 10 has an oil groove 16, a plurality of emulsifying pipes 17 connecting with the oil groove 16 (please refer to FIG. 6) and two channels 18 connecting with the oil groove 16 and the exit for the main oil path 15 thereinside. The emulsifying pipes 17 include two emulsifying pipes for the main oil path 171 and an emulsifying pipe for the auxiliary oil path 172. Fuel in the oil groove 16 can flow to the exit for the main oil path 15 through the emulsifying pipes for the main oil path 171 and the channels 18.

The Venturi cone assembly 20 is mounted in the center flow path 11 and includes a fixing axle 21, a cone 22, at least one recovery element 23, and a supporting block 24. The fixing axle 21 is fixed on the supporting portion 14. The cone 22 is movably shafted via the fixing axle 21 and forms a Venturi throat passage 111 with the base 10, the supporting portion 14, and the exit for the main oil path 15. The recovery element 23 is a spring mounted inside the cone 22. Two ends of the recovery element 23 abut against with the fixing axle 21 and an inner edge of the cone 22, respectively, so that one end of the cone 22 contacts the supporting portion 14. The supporting block 24 is disposed at the other end of the cone 22 and covers the recovery element 23 inside the cone 22.

The cam assembly 30 includes a cam spindle 31, a cam 32, and a connecting board 33. The cam spindle 31 is pivotedly mounted close to a center of the base 10. The cam 32 and the connecting board 33 are respectively mounted inside and outside the base 10 and both connect with the cam spindle 31, via which the cam 32 and the connecting board 33 can be driven to rotate. The cam 32 collides with the supporting block 24 of the Venturi cone assembly 20. A fine-tuning screw for a cam location 34 extends through a free end of the connecting board 33.

The horsepower adjustment assembly 40 includes a fixed shaft for a fan blade 41, a fan blade 42, an oil line rotation wheel 43, and a locating board 44. The fixed shaft for a fan blade 41 is pivotedly mounted on the base 10 close to the air outlet port 13 and the cam assembly 30. The fan blade 42 and the oil line rotation wheel 43 are respectively mounted inside and outside the base 10 and connect with the fixed shaft for a fan blade 41. The locating board 44 is disposed outside the oil line rotation wheel 43, and connects with the fixed shaft for a fan blade 41. Moreover, the locating board 44 abuts against the fine-tuning screw for the cam location 34.

The vacuum horsepower adjustment valve 50 is mounted on a top of the base 10. The vacuum horsepower adjustment valve 50 is connected with the center flow path 11 by a vacuum through hole 19 in the base 10 so that air can enter the vacuum horsepower adjustment valve 50 through the vacuum through hole 19. The vacuum horsepower adjustment valve 50 includes a vacuum valve cover 51, a film 52, an auxiliary oil needle 53, at least one elastic element 54, and two oil needle fixed pieces 55 and 55'. The film 52 is placed between the vacuum valve cover 51 and the base 10 and connects with the auxiliary oil needle 53. The auxiliary oil needle 53 vertically penetrates through the base 10 and movably extends into the center path 11. The film 52 is held by two oil needle fixed pieces 55 and 55'. The elastic element 54 is a spring, of which two ends respectively abut against the oil needle fixed piece 55 on an under surface of the film 52 and the base 10. One end of the auxiliary oil needle 53 abuts against an adjusting screw 56 on a top of the vacuum valve cover 51.

Figure 4:
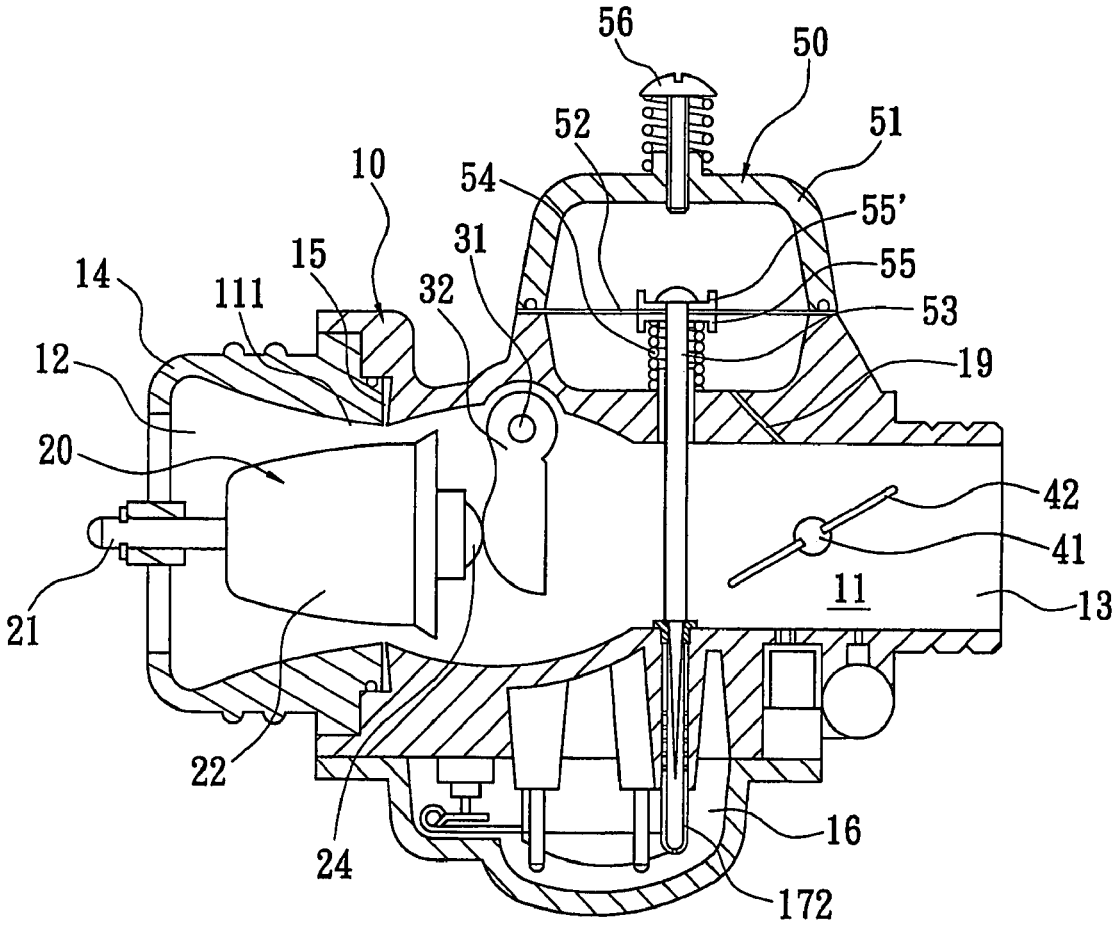
FIG. 4 is a sketched view of the fan blade of the present invention, in a half open state.

The air inlet port 12 and the air outlet port 13 of the base 10 of the present invention respectively connecting with an air filter and an engine via Intake manifolds (not shown). FIG. 2 and FIG. 4 show that when a locomotive accelerates, the oil line rotation wheel 43 is drawn by an oiling line 45 which drives the oil line rotation wheel 43 to rotate clockwise, so that the fixed shaft for a fan blade 41 of the oil line rotation wheel 43 rotates to drive the fan blade 42 inside the base 10 to open. At this time, vacuum suction from the engine attracts the cone 22 of the Venturi cone assembly 20 to move towards the air outlet port 13 and lead air to enter the base 10 through the Venturi throat passage 111 from the air inlet port 12. Based on the Venturi principle (air causes negative pressure in the base 10), the fuel in the oil groove 16 overflows the exit for the main oil path 15 along the channels 18 (please refer to FIG. 6 simultaneously), mixes with air into mixture of fuel and gas and then enters the engine. Simultaneously, because the locating board 44 of the oil line rotation wheel 43 rotates clockwise, the fine-tuning screw for the cam location 34 colliding with the locating board 44 drives the connecting board 33. Thereby the cam spindle 31 rotates anticlockwise to drive the cam 32 inside the base 10 to rotate and collide with the supporting block 24 of the Venturi cone assembly 20 in a predetermined position so that the cone 22 is stably limited in a proper place to maintain continuous and proper supply of the fuel. At the same time, because the vacuum suction from the engine increases, the auxiliary oil needle 53 is attracted to move downwards to seal an outlet of the emulsifying pipe for the auxiliary oil path 172 which connects with the oil groove 16 in the base 10 so that the primary fuel is provided by the exit for the main oil path 15 as full as possible, and the emulsifying pipe for the auxiliary oil path 172 only provides a few additional fuel.

Figure 5:
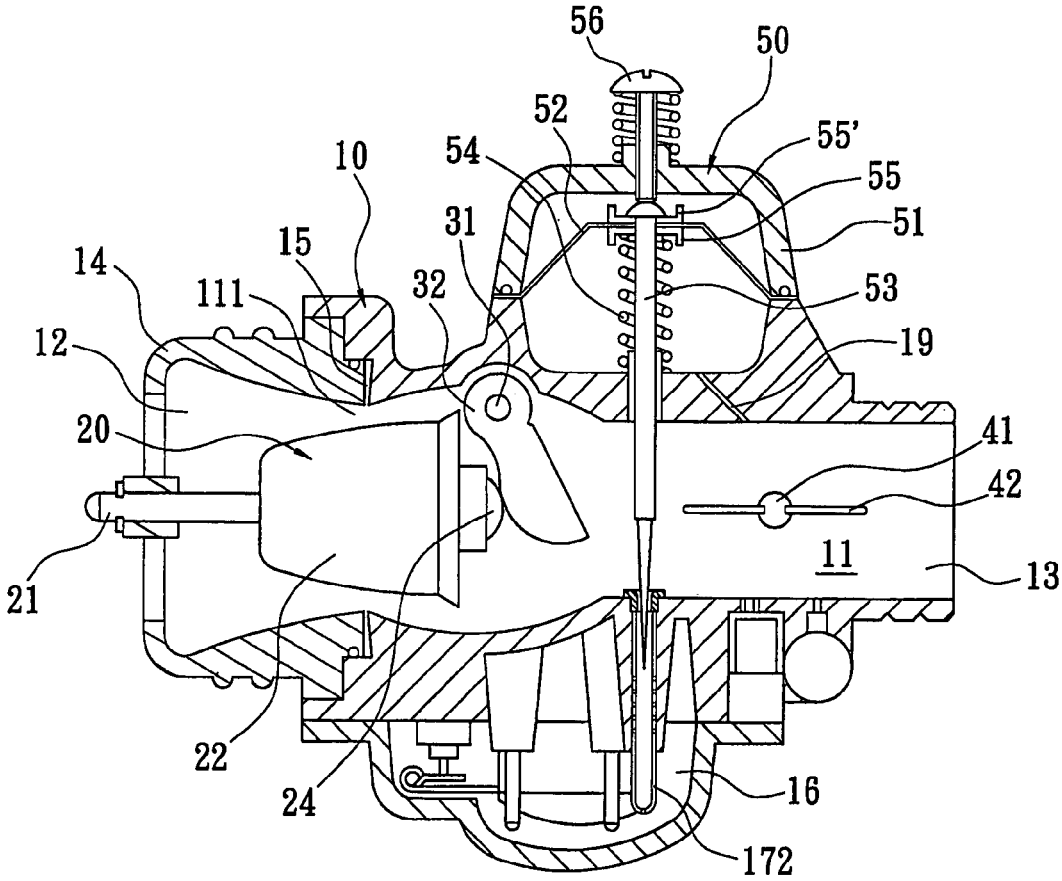
FIG. 5 is a sketched view of the fan blade of the present invention, in a full open state.

As shown in FIG. 5, when the locomotive runs rapidly or climbs hillsides, the fan blade 42 opens completely so that the vacuum suction from the engine is reduced so air enters the vacuum horsepower adjustment valve 50 through the vacuum through hole 19 and pushes the film 52 upwards, and then further pushes the auxiliary oil needle 53 via the two oil needle fixed pieces 55, 55'. Therefore the auxiliary oil needle 53 withdraws and no longer seals the outlet of the emulsifying pipe for the auxiliary oil path 172. Subsequently, the fuel will enter the center flow path 11 via the outlet of the emulsifying pipe for the auxiliary oil path 172 from the oil groove 16 and mix with air and then enter the engine. Thereby the engine obtains more and proper mixture of fuel and gas and increases power to increase the speed of the locomotive.

Figure 7:
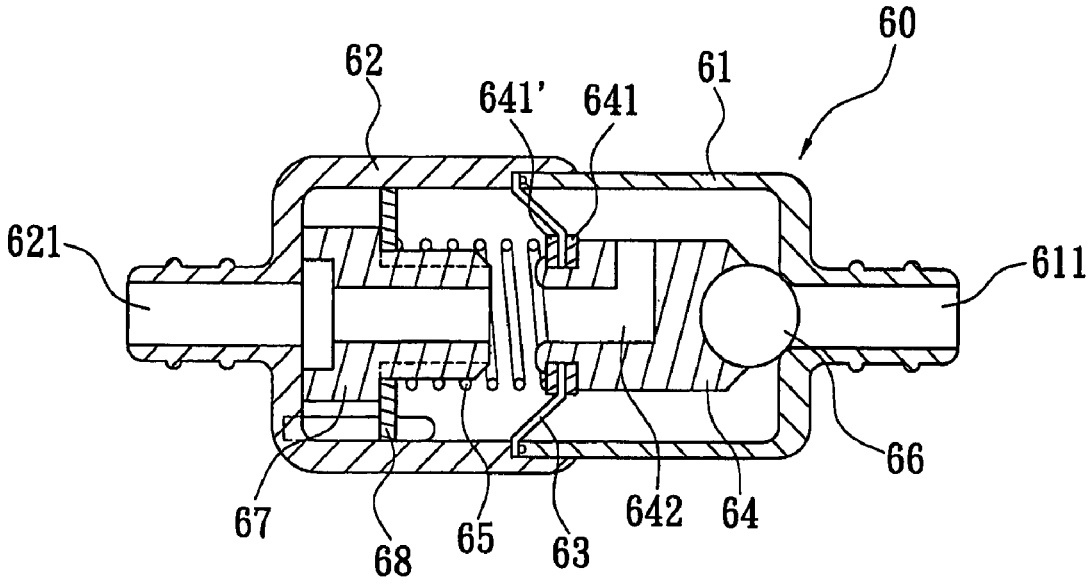
FIG. 7 is a sectional view of an air compensation valve of the present invention.
Figure 8:
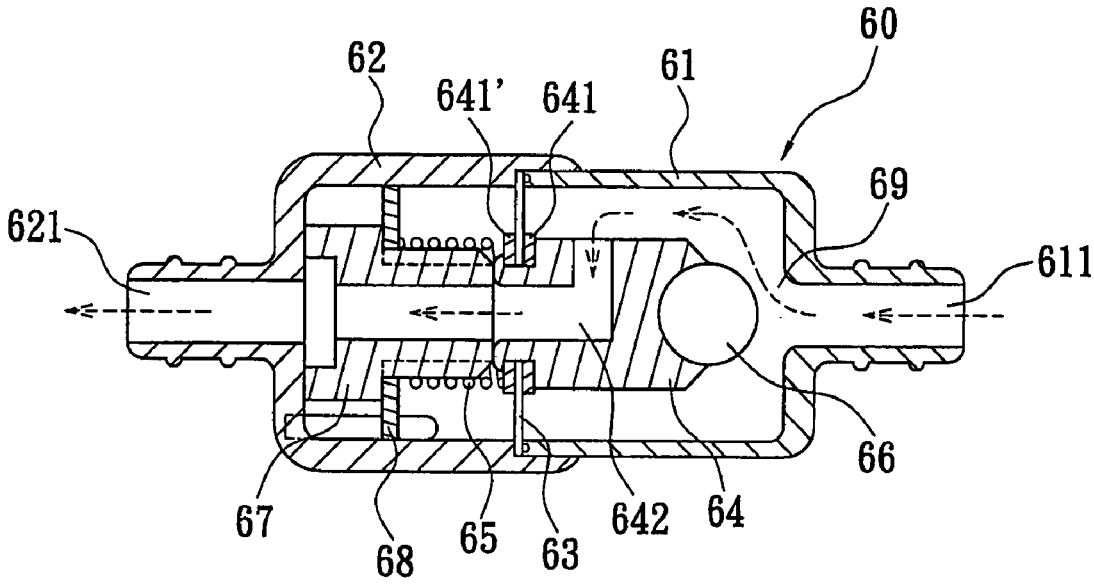
FIG. 8 is a sketched view of the air compensation valve of the present invention, in a used state.

The carburetor of the present invention can further connect with an air compensation valve 60 (as shown in FIG. 7). The air compensation valve 60 includes a front base 61, a back base 62, a pneumatic film 63, a supporting pole 64, a resisting assembly 65, and a locating steelball 66. An air inlet hole 611 and an air outlet hole 621 are respectively formed on two ends of the front base 61 and the back base 62 and respectively connect with the air inlet port 12 and the air outlet port 13 via air inlet manifolds. The back base 62 and the front base 61 combine with each other. The pneumatic film 63 is disposed between the front base 61 and the back base 62. An inner side of the pneumatic film 63 is fixed on a supporting pole 64 via an upper fixing ring 641 and a lower fixing ring 641'. One end of the supporting pole 64 contacts the resisting assembly 65, and the other end of the supporting pole 64 abuts against the locating steelball 66 so that the locating steelball 66 seals the air inlet hole 611. The resisting assembly 65 is a spring. The other end of the resisting assembly 65 elastically collides with a locating screw sheath 68 mounted on the locating pin 67 so when the brakes are applied to the locomotive when it is running at a high speed, vacuum suction from the engine can not only take in the mixture of fuel and air from the air outlet port 13 of the carburetor, but also take in air from the air outlet hole 621 of the air compensation valve 60. When air in the air compensation valve 60 is exhausted and a vacuum is formed in the air compensation valve 60 the locating steelball 66 will be attracted to move towards the air outlet hole 621 and no longer seal the air inlet hole 611 (as shown in FIG. 8) so that air in the air filter can enter the air compensation valve 60 via the air inlet hole 611. Air then enters the through hole 642 in the supporting pole 64 along a hole path which is formed by a gap between the locating steelball 66 and the front base 61 and goes through the locating pin 67 and the air outlet hole 621 to arrive at the engine. Accordingly, the mixture of fuel and air taken in by the engine can be diluted by air, and the carburetor no longer needs to take in so much mixture of fuel and air, thereby reducing waste gas exhausted into the air and reducing pollution. Additionally, the air compensation valve 60 of the present invention does not operate during normal driving, except to operate forcibly under strong vacuum suction from the engine when the brakes of the locomotive are applied when it is running at a high speed. When the vacuum suction from the engine reduces, the resisting assembly 65 pushes the supporting pole 64 to make the locating steelball 66 move back and collide with and seal the air inlet hole.

Accordingly, the features and efficacy of the present invention can be summed up as follows:

1. The exit for the main oil path 15 of the present invention is mounted in a gap between the base 10 and the supporting portion 14, so that the overflowed fuel particles doesn't become too large, so the fuel can burn sufficiently and air pollution is reduced.

2. The present invention forms the exit for the main oil path 15 in front of the cone 22, so that besides choke effect, the cone 22 also can block the fuel so that the carburetor has better stability for controlling the fuel and air.

3. The cam 32 of the present invention can effectively control the shift of the cone 22 of the Venturi cone assembly 20 under vacuum suction from the engine, thereby the mixture of the fuel and air is more stable.

4. The vacuum horsepower adjustment valve 50 of the present invention can automatically adjust the fuel supply via vacuum suction from the engine at varied speeds to provide greater horsepower.

What is disclosed above is only the preferred embodiment of the present invention and it is therefore not intended that the present invention be limited to the particular embodiments disclosed. It will be understood by those skilled in the art that various equivalent changes may be made depending on the specification and the drawings of present invention without departing from the scope of the present invention.

What is claimed is:

1. A carburetor, comprising:

a base, having a center flow path with an air inlet port and an air outlet port respectively disposed on two ends thereof, wherein the base defines a supporting portion on one side of the air inlet port, the supporting portion and the base are forming an annular exit for the main oil path therebetween;

a Venturi cone assembly, mounted in the center flow path and including a fixing axle and a cone, wherein the fixing axle is fixed on the supporting portion and the cone movably is shafted via the fixing axle;

a cam assembly, including a cam spindle, a cam, and a connecting board, wherein the cam spindle is pivotedly mounted close to a center of the base, the cam and the connecting board are respectively mounted inside and outside the base and connect with the cam spindle, and the cam abuts against the Venturi cone assembly;

a horsepower adjustment assembly, including a fixed shaft for a fan blade, a fan blade, and an oil line rotation wheel, wherein the fixed shaft for a fan blade is pivotedly mounted on the base close to the air outlet port on the same side as the cam assembly, the fan blade and the oil line rotation wheel are respectively mounted inside and outside the base and connect with the fixed shaft for a fan blade; and a vacuum horsepower adjustment valve, mounted on a top of the base and including a vacuum valve cover and an auxiliary oil needle, a film placed between the vacuum valve cover and the base wherein the film connects with the auxiliary oil needle, and the auxiliary oil needle vertically penetrates through the base and movably extends into the center flow path.

2. The carburetor as claimed in claim 1, wherein the base has an oil groove connected with a plurality of emulsifying pipes and a vacuum through hole connecting with the vacuum horsepower adjustment valve and the center flow path thereinside, and two channels connecting with the exit for the main oil path.

3. The carburetor as claimed in claim 1, wherein the Venturi cone assembly has at least one recovery element mounted inside the cone wherein two ends thereof respectively abut against the fixing axle and an inner edge of the cone, and a supporting block disposed at one end of the cone and abutted against with the cam.

4. The carburetor as claimed in claim 1, wherein a fine-tuning screw for the cam location penetrates through a free end of the connecting board, the horsepower adjustment assembly has a locating board disposed outside the oil line rotation wheel and connecting with the fixed shaft for a fan blade, and the locating board abuts against the fine-tuning screw for the cam location.

5. The carburetor as claimed in claim 1, wherein the vacuum horsepower adjustment valve has at least one elastic element, the film is held by two oil needle fixed pieces, and two ends of the elastic element respectively abut against the oil needle fixed piece on an under surface of the film and the base.

6. The carburetor as claimed in claim 1, further connecting with an air compensation valve, wherein the air compensation valve includes a front base and a back base combined with the front base, an air inlet hole and an air outlet hole are respectively formed on two ends of the front base and the back base and connect with the air inlet port and the air outlet port via air inlet manifolds.

7. The carburetor as claimed in claim 6, wherein the air compensation valve further includes a supporting pole, a resisting assembly and a locating steelball, wherein one end of the supporting pole contacts the resisting assembly and the other end of the supporting pole collides with the locating steelball.

* * * * *